US007885563B2

(12) United States Patent
Yamamura

(10) Patent No.: US 7,885,563 B2
(45) Date of Patent: Feb. 8, 2011

(54) DEVELOPMENT APPARATUS AND IMAGE FORMING APPARATUS

(75) Inventor: Akihiro Yamamura, Tokyo (JP)

(73) Assignee: Oki Data Corporation, Tokyo (JP)

( * ) Notice: Subject to any disclaimer, the term of this patent is extended or adjusted under 35 U.S.C. 154(b) by 662 days.

(21) Appl. No.: 11/511,266

(22) Filed: Aug. 29, 2006

(65) Prior Publication Data

US 2007/0065167 A1 Mar. 22, 2007

(30) Foreign Application Priority Data

Sep. 21, 2005 (JP) ..... 2005-274769

(51) Int. Cl.
*G03G 15/06* (2006.01)

(52) U.S. Cl. ..... 399/55; 399/281; 399/285

(58) Field of Classification Search ..... 399/55, 399/281, 285

See application file for complete search history.

(56) References Cited

U.S. PATENT DOCUMENTS

| | | | | |
|---|---|---|---|---|
| 5,634,181 | A * | 5/1997 | Tachibana et al. | 399/254 |
| 5,839,021 | A | 11/1998 | Hayashi et al. | |
| 6,035,171 | A * | 3/2000 | Takaya et al. | 399/281 |
| 2005/0191073 | A1* | 9/2005 | Kawamura et al. | 399/55 |

FOREIGN PATENT DOCUMENTS

| | | | |
|---|---|---|---|
| JP | 63-101879 | A | 5/1988 |
| JP | 01-178989 | A | 7/1989 |
| JP | 06-003942 | A | 1/1994 |
| JP | 10-039628 | | 2/1998 |
| JP | 11-015263 | A | 1/1999 |
| JP | 11-149213 | A | 6/1999 |
| JP | 2001-209248 | A | 8/2001 |
| JP | 2001-249532 | A | 9/2001 |

* cited by examiner

*Primary Examiner*—Ryan D Walsh
(74) *Attorney, Agent, or Firm*—Rabin & Berdo, P.C.

(57) ABSTRACT

A development apparatus is provided that can quickly form high quality printing material by steadily supplying developer charged and thinned to a uniform thickness and can also prevent the decrease in the quality of the printing material in a case where the developer carrier and developer supply unit are operated quickly. The toner supply roller is constructed in a manner using the elastic material with a hardness of $H_{AF}$ [degree] set to $20 \leqq H_{AF} \leqq 80$ measured by an Asker F-type and disposed in a manner such that the amount of push δ, defined as the amount pushed by the contact between the developer supply unit and the developer carrier, is 0.5 [mm] or below. In addition, toner supply bias voltage $V_S$ [V] applied to the toner supply roller has a frequency f [Hz] of $500 \leqq f \leqq 5000$, and, with $V_{SH}$ and $V_{SL}$ as the peak values of the AC voltage component, fulfill the condition of $1 \leqq |V_{SH}-V_D|/|V_D-V_{SL}| \leqq 5$.

9 Claims, 11 Drawing Sheets

DEVELOPMENT APPARATUS AND IMAGE FORMING APPARATUS

BACKGROUND OF THE INVENTION

1. Field of the Invention

The present invention relates to a development apparatus that uses developer to develop an electrostatic latent image formed on an electrostatic latent image carrier and an image forming apparatus containing the development apparatus.

2. Description of Related Art

Conventionally, an image forming apparatus using an electrophotographic recording method is known to form an image by heat fusing a developer image onto a prescribed recording medium. This type of image forming apparatus, as shown, for example, in Japanese Patent Application Publication No. 10-39628, forms an image through a series of processes, which are a charging process that charges a photosensitive insular layer forming a photosensitive body with a uniform voltage, an exposure process that forms the electrostatic latent image on the photosensitive body by eliminating charge on a portion that was exposed by irradiating the photosensitive insular layer with modulated light based on image data, a development process that visualizes the electrostatic latent image by affixing developer (hereinafter referred to as toner) that includes at least coloring to the formed electrostatic latent image, a transfer process that transfers the visible image to a transfer material such as transfer paper (printing medium), and a fusion process that fuses the visible image on the transfer material using heat and pressure, or any other suitable fusion method.

However, in the conventional image forming apparatus described in the aforementioned patent document, toner that is charged and thinned to a uniform thickness cannot be steadily supplied because of the deterioration of a development roller, toner supply roller, and toner caused by friction between the toner supply roller that supplies toner to the development roller and the development roller that affixes toner to the photosensitive body by rotating and contacting the photosensitive body. This inability to steadily supply toner results in a decrease in quality of the printing material. In addition, in the conventional image forming apparatus, because the a large amount of torque is necessary to drive the rotation of the development roller and the toner supply roller, irregularities arise in the rotation in a case where an operation is performed quickly, causing a decrease in the quality of the printing material.

SUMMARY OF THE INVENTION

The present invention takes the aforementioned situation into account and aims to provide an image forming apparatus and development apparatus that can quickly form a high quality printing material by steadily supplying toner charged and thinned to a uniform thickness, prevent the deterioration of the development roller, toner supply roller, and toner caused by friction between the toner supply roller and the development roller, and can also prevent the decrease in quality of the printing material in a case where the operation is performed quickly by lowering the amount of torque necessary to drive the rotation of the development roller and toner supply roller.

To achieve the objective described above, the development apparatus of the present invention, for developing the electrostatic latent image formed on the electrostatic latent image carrier, contains a developer carrier for affixing developer to the electrostatic latent image carrier by rotating in a direction facing a circumferential surface of the electrostatic latent image carrier and for applying a development bias voltage $V_D$ [V] that is a prescribed DC voltage, a developer supply unit with a circumferential surface formed of an elastic material with a prescribed hardness and disposed rotatably contacting the developer carrier to supply developer to the developer carrier, and a developer layer formation unit for thinning developer supplied to the circumferential surface of the developer carrier by the developer supply unit. In the development apparatus of the present invention, the developer supply unit is constructed in a manner using the elastic material with a hardness of $H_{AF}$[degree] set to $20 \leqq H_{AF} \leqq 80$ measured by an Asker F-type and disposed in a manner such that the amount of push δ, defined as the amount pushed by the contact between the developer supply unit and the developer carrier, is 0.5 [mm] or below, the developer supply bias voltage superimposing AC voltage on the prescribed DC voltage is applied to the developer supply unit, the developer supply bias voltage $V_S$ [V] has a frequency f [Hz] of $500 \leqq f \leqq 5000$, and the conditions of Equation 1 are fulfilled with $V_{SH}$ as the large peak value with a polarity opposite to the charge polarity of the toner and $V_{SL}$ as the large peak value with the same polarity as the charge polarity of the toner.

$$1 \leqq |V_{SH}-V_D|/|V_D-V_{SL}| \leqq 5 \qquad \text{Equation 1}$$

The development apparatus of the present invention can steadily supply developer charged and thinned to a uniform thickness and prevent the deterioration of developer carrier, developer supply unit, and developer caused by friction between the developer carrier and the developer supply unit. Accordingly, the development apparatus of the present invention can quickly form a high quality printing material. In addition, the development apparatus of the present invention, when compared to a conventional development apparatus, requires less torque to drive the rotation of the developer carrier and the developer supply unit, thereby preventing a decrease in quality of the printing material even in a case where the operation is performed quickly.

In addition, to achieve the objective described above, the development apparatus of the present invention, for developing the electrostatic latent image formed on the electrostatic latent image carrier, contains a developer carrier for affixing developer to the electrostatic latent image carrier by rotating in a direction facing a circumferential surface of the electrostatic latent image carrier and for applying a development bias voltage $V_D$ [V] that is a prescribed DC voltage, a developer supply unit with a circumferential surface formed of an elastic material with a prescribed hardness and disposed rotatably contacting the developer carrier to supply developer to the developer carrier, and a developer layer formation unit for thinning developer supplied to the circumferential surface of the developer carrier by the developer supply unit. In the development apparatus of the present invention, the developer supply unit is constructed in a manner using the elastic material with a hardness of $H_{AF}$ [degree] set to $20 \leqq H_{AF} \leqq 80$ measured by an Asker F-type and disposed in a manner such that the amount of push δ, defined as the amount pushed by the contact between the developer supply unit and the developer carrier, is 0.5 [mm] or below, the developer supply bias voltage superimposing AC voltage on the prescribed DC voltage is applied to the developer supply unit, the developer supply bias voltage $V_S$ [V] has a frequency f [Hz] of $500 \leqq f \leqq 5000$, with $V_{SH}$ as the large peak value with a polarity opposite to the charge polarity of the toner, $V_{SL}$ as the large peak value with the same polarity as the charge polarity of the toner, and the relation between the development bias voltage $V_D$ [V] and the developer supply bias voltage $V_S$ fulfilling the conditions of Equation 2 with $T_S$ set as a time when $V_{SL}<V_S<V_D$ and $T_R$ set as a time when $V_D<V_S<V_{SH}$.

$$1 \leqq T_R/T_S \leqq 5 \quad \text{Equation 2}$$

The development apparatus of the present invention can steadily supply developer charged and thinned to a uniform thickness and prevent the deterioration of developer carrier, developer supply unit, and developer caused by friction between the developer carrier and the developer supply unit. Accordingly, the development apparatus of the present invention can quickly form a high quality printing material. In addition, the development apparatus of the present invention, when compared to a conventional development apparatus, requires less torque to drive the rotation of the developer carrier and the developer supply unit, thereby preventing a decrease in quality of the printing material even in a case where the operation is performed quickly. Further, the development apparatus of the present invention can prevent fog arising from the developer charged with reverse polarity, caused by large peak values of the AC voltage component of the developer supply bias voltage $V_S$ [V] with polarity opposite to the charge polarity of the developer, even if the amplitude of the AC voltage component of the developer supply bias voltage $V_S$ is small, since the effect can sufficiently be achieved.

The present invention can quickly form high quality printing material by steadily supplying developer charged and thinned to a uniform thickness and can also prevent the decrease in the quality of the printing material in a case where the developer carrier and developer supply unit are operated quickly.

BRIEF DESCRIPTION OF THE DRAWINGS

This invention may take physical form in certain parts and arrangements of parts, a preferred embodiment and method of which will be described in detail in this specification and illustrated in the accompanying drawings which form a part hereof, and wherein.

DESCRIPTION OF PREFERRED EMBODIMENTS

The following is a detailed explanation, referencing diagrams, of a concrete embodiment applicable to the present invention.

This embodiment is an image forming apparatus containing the development apparatus that uses developer to develop the electrostatic latent image formed on the electrostatic latent image carrier. The image forming apparatus contains a developer carrier that affixes toner as the developer to a photosensitive drum by rotating in a direction facing the photoconductive drum serving as the electrostatic latent image carrier. The image forming apparatus also contains the development apparatus that fulfills conditions revealed by the results of the committed research of the applicant concerning the quality, setup condition, voltage application, and the like of the developer supply unit supplying developer to the developer carrier.

First, the image forming apparatus shown in the first embodiment will be explained.

Figure 1:
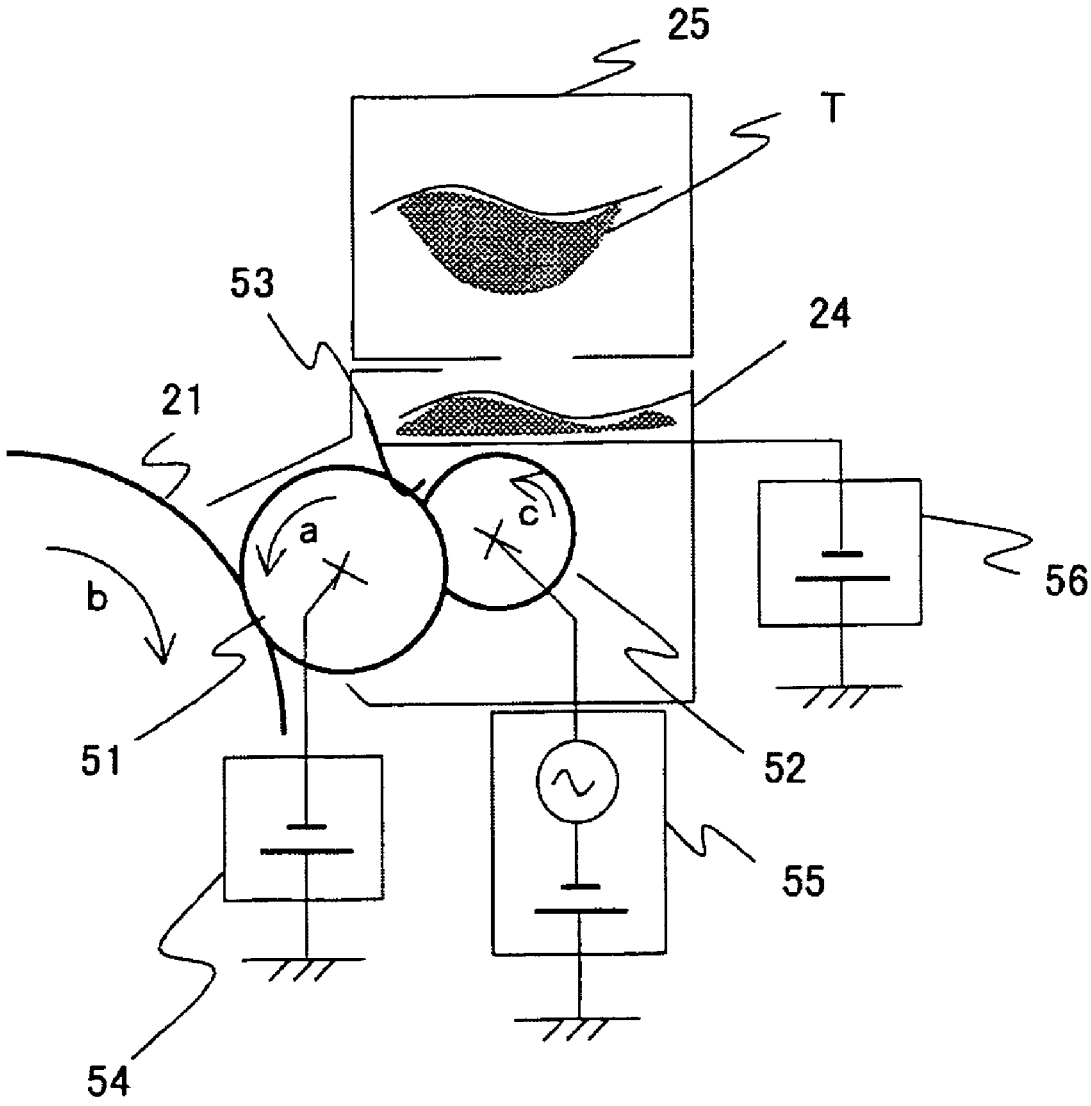
FIG. 1 is a lateral cross-sectional diagram describing the structure of the development apparatus of the image forming apparatus shown as the first embodiment of the present invention.
Figure 2:
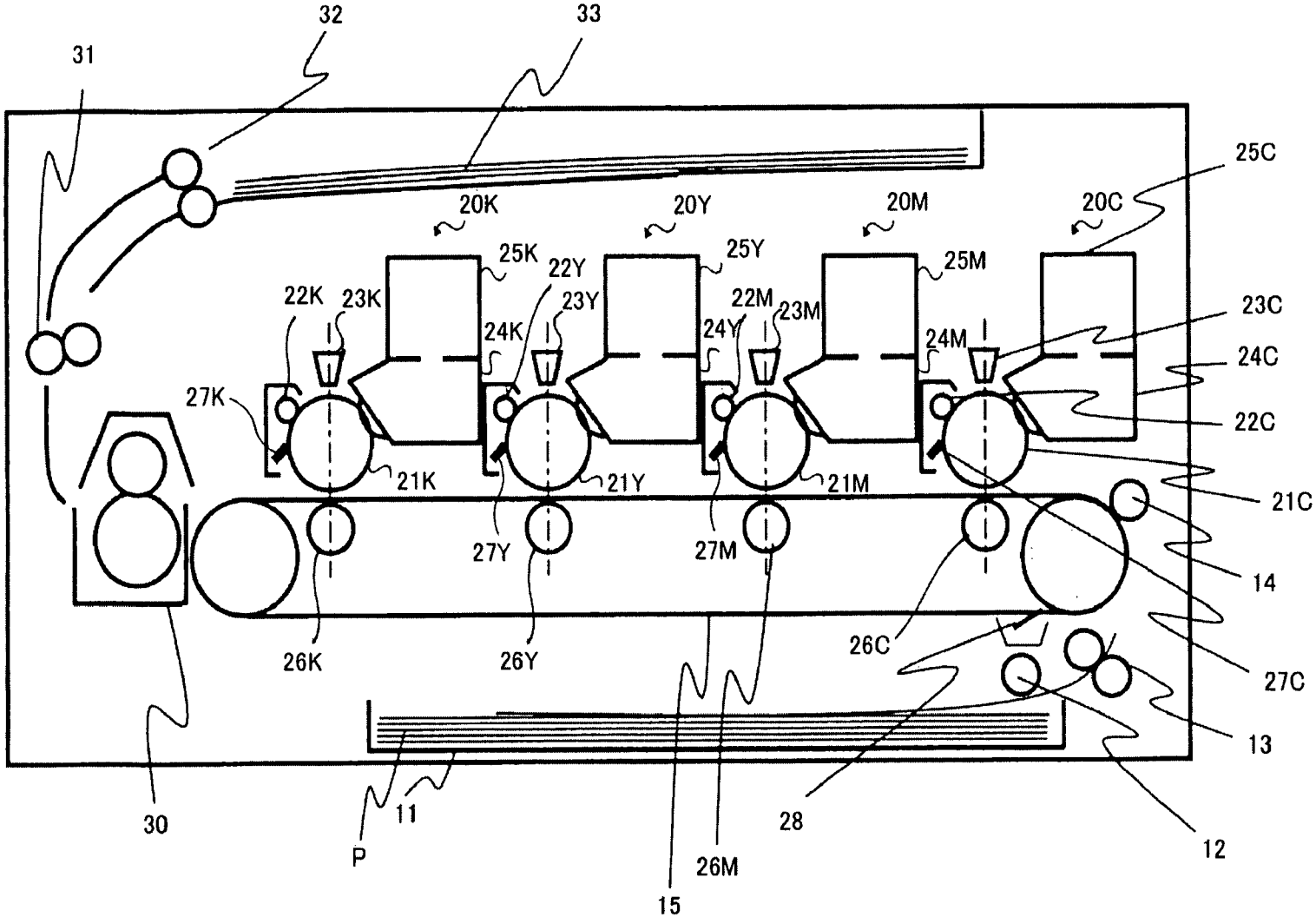
FIG. 2 is a lateral cross-sectional diagram describing the structure of the image forming apparatus shown as the first embodiment of the present invention.

FIG. 1 is a lateral cross section diagram showing the structure of the development apparatus of the image forming apparatus, and FIG. 2 is a lateral cross section diagram showing the structure of the image forming apparatus. As shown in FIG. 2, the image forming apparatus contains a paper tray 11 for storing a printing medium P on which the image has not yet been formed. The printing medium P stored in the paper tray 11 is sent out according to the rotation of a paper supply roller 12 and, further, the printing medium P is fed with a prescribed timing, according to the rotation of feeding rollers 13 and 14 positioned downstream from the paper supply roller 12, to a transfer belt 15 that rotates with a rotation speed corresponding to the printing speed that is determined by a motor, not shown.

In addition, the image forming apparatus contains four image forming units 20C, 20M, 20Y, and 20K that respectively correspond to the four colors cyan (C), magenta (M), yellow (Y), and black (K). The image forming units are lined up in the above order along the transfer belt 15, from the paper supply side where the printing medium P enters to the paper delivery side where the printing medium P is ejected. The image forming units 20C, 20M, 20Y, and 20K form the image, using each color of toner, on the printing medium P positioned on the transfer belt 15, which has its rotation driven by a motor, drive gear, or the like, not shown. Specifically, the image forming units 20C, 20M, 20Y, and 20K each contain photosensitive drums 21C, 21M, 21Y, and 21K as the electrostatic latent image carrier, charge rollers 22C, 22M, 22Y, and 22K for charging the circumferential surface of the photosensitive drums 21C, 21M, 21Y, and 21K, exposure apparatuses 23C, 23M, 23Y, and 23K for forming the electrostatic latent image by selectively shining light on and exposing the circumferential surface of the photosensitive drums 21C, 21M, 21Y, and 21K via an interface unit, not shown, based on image data received from an external apparatus, development apparatuses 24C, 24M, 24Y, and 24K for developing with toner the electrostatic latent image formed on the circumferential surface of each of the photosensitive drums 21C, 21M, 21Y, and 21K, toner cartridges 25C, 25M, 25Y, and 25K for storing the toner supplied to each of the development apparatuses 24C, 24M, 24Y, and 24K, transfer rollers 26C, 26M, 26Y, and 26K for transferring the toner image acquired from the electrostatic latent image made visible by toner to the printing medium P, and cleaning blades 27C, 27M, 27Y, and 27K for cleaning the toner that was unable to be transferred to the printing medium P and remains on the circumferential surface of the photosensitive drums 21C, 21M, 21Y, and 21K. In addition, the photosensitive drums 21C, 21M, 21Y, and 21K, the charge rollers 22C, 22M, 22Y, and 22K, and the transfer rollers 26C, 26M, 26Y, and 26K are each constructed in a manner to have their rotation driven by a motor, drive gear, or the like, not shown. Further, the exposure apparatuses 23C, 23M, 23Y, and 23K, the development apparatuses 24C, 24M, 24Y, and 24K, and the motor, not shown, are each connected to a control unit and power source, not shown.

Under the control of the control unit, not shown, with a uniform voltage charged on the circumferential surface of the photosensitive drums 21C, 21M, 21Y, and 21K by the charge rollers 22C, 22M, 22Y, and 22K having the prescribed voltage applied by the power source, not shown, the image forming units 20C, 20M, 20Y, and 20K, upon the arrival of the charged circumferential surface at a location near the exposure apparatuses 23C, 23M, 23Y, and 23K as a result of the rotation of the photosensitive drums 21C, 21M, 21Y, and 21K, form the electrostatic latent image using the exposure apparatuses 23C, 23M, 23Y, and 23K to expose the photosensitive drums 21C, 21M, 21Y, and 21K to an image modulating light. The image forming units 20C, 20M, 20Y, and 20K generate a toner image with each color by affixing the toner of each color supplied by the development apparatuses 24C, 24M, 24Y, and 24K to the formed electrostatic image.

Under the control of the control unit, not shown, along with the arrival of the transfer rollers 26C, 26M, 26Y, and 26K, arranged in a direction opposite the photosensitive drums 21C, 21M, 21Y, and 21K to sandwich the transfer belt 15 and a toner image generated on the circumferential surface of the transfer belt 15, at a location near the photosensitive drums 21C, 21M, 21Y, and 21K as a result of the rotation of the photosensitive drums 21C, 21M, 21Y, and 21K, and in accordance with the printing medium P being fed by the transfer belt 15, the multi-colored toner image formed by the image forming units 20C, 20M, 20Y, and 20K is transferred and stacked sequentially on the printing medium P by the transfer rollers 26C, 26M, 26Y, and 26K. At this time, the prescribed voltage is applied to the transfer rollers 26C, 26M, 26Y, and 26K by the power source, not shown.

Upon completion of the transfer, under the control of the control unit, not shown, the image forming units 20C, 20M, 20Y, and 20K clean the toner remaining on the circumferential surface of the photosensitive drums 21C, 21M, 21Y, and 21K using the cleaning blades 27C, 27M, 27Y, and 27K. In addition, under the control of the control unit, not shown, the image forming apparatus cleans the toner remaining on the circumferential surface of the transfer belt 15 using a cleaning blade 28. In the image forming apparatus, the multi-colored image is formed sequentially on the printing medium P and a color image is formed using the image forming units 20C, 20M, 20Y, and 20K, structured as described above. In the image forming apparatus, the printing medium P is fed into the fusion apparatus 30 in a condition where the toner is electrically affixed.

The image forming apparatus further contains a fusion apparatus 30 located downstream from the image forming units 20C, 20M, 20Y, and 20K. The fusion apparatus 30 contains a fusion roller, having a structure where, for example, an elastic material is fastened around a hollow metal roller, and a pressure roller that, along with the fusion roller, applies pressure on the printing medium P. The pressure roller is arranged in a manner contacting the fusion roller in an opposite direction, forming a nip unit that sandwiches the printing medium P. In addition, a halogen lamp or heater that generates light and heat using a power source, not shown, is located inside the fusion roller. Under the control of the control unit, not shown, the fusion roller in the fusion device 30 is heated by supplying power to the heater and light generation of the halogen lamp. The fusion apparatus 30 feeds the printing medium P to the nip unit using the fusion roller and the pressure roller, melts the toner on the printing medium P by applying heat and pressure, and fuses the toner image with heat. In the image forming apparatus, upon fusion of the image on the printing medium P by the fusion apparatus 30, the printing medium P is fed and delivered outside the apparatus and stacked on a paper delivery unit 33 in accordance with the rotation of a feeding roller 31 and a delivery roller 32.

In the image forming apparatus, the development apparatuses 24C, 24M, 24Y, and 24K are structured in a manner shown in FIG. 1. In addition, in the image forming apparatus, the image forming units 20C, 20M, 20Y, and 20K that correspond to the aforementioned colors cyan (C), magenta (M), yellow (Y), and black (K) are all constructed in the same manner, and therefore the following explanation will be without using the letters C, M, Y, and K for each of the units in the apparatus, being referred to simply as, for example, the image formation unit 20.

As shown in the same diagram, the development unit 24 contains a development roller 51 as a developer carrier formed by wrapping a semiconductive gum layer around a conductive shaft, a toner supply roller 52 as a developer supply unit formed by wrapping a semiconductive gum layer around a conductive shaft, and a development blade as a developer layer formation unit that thins and charges the toner T that is the developer supplied from the toner cartridge 25.

The development roller 51 is a unit that fuses the toner T to the photosensitive drum 21 by rotating and contacting the circumferential surface of the photosensitive drum 21, and rotation of the development roller 51 is driven by a motor, drive gear, or the like, not shown. In addition, a developing bias power source apparatus 54 that applies a developing bias voltage, which is a prescribed DC voltage, is connected to the conductive shaft of the development roller 51. The toner supply roller 52 is a unit arranged in a rotatable manner directly contacting the development roller 51 to supply the toner T to the development roller 51, and the rotation of the toner supply roller 52 is driven by a motor, drive gear, or the like, not shown. In addition, a toner supply bias power source apparatus 55 that applies a developing bias voltage with an AC voltage superimposed on the prescribed DC voltage is connected to the conductive shaft of the development roller 51. The development blade 53 is a unit positioned to directly contact the circumferential surface of the development roller 51 and thins and charges the toner T supplied to the circumferential surface of the development roller 51 based on a toner layer formation bias voltage, which is a prescribed DC voltage, applied by a toner layer formation bias power source apparatus 56.

Figure 3:
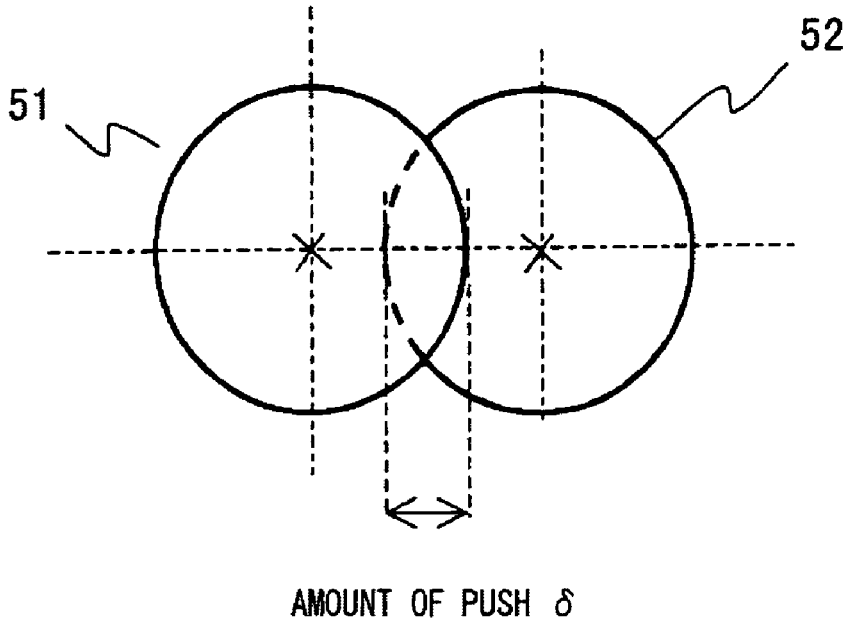
FIG. 3 is a diagram explaining the definition of the amount of push and the relevant parts of development apparatus shown in FIG. 2.

In the development apparatus 24, the development roller 51 and the photosensitive drum 21 are arranged to be in direct contact and to be rotatable in a direction shown by arrows a and b of FIG. 1. In addition, in the development apparatus 24, the toner supply roller 52 and the development roller 51 are arranged to be pressed together and to be rotatable in a direction shown by arrows c and a of the same diagram. Further, as shown in FIG. 3, the amount of push, δ, is defined as the length, from the straight lines tying the center of rotation of the development roller 51 and the toner supply roller 52, of the overlapping portions of the development roller 51 and the toner supply roller 52. In other words, the amount of push δ is the amount of pushing force exerted by the contact of the toner supply roller 52 and the development roller 51. In addition, a condition where the amount of push δ<0 shows that a gap, represented by −δ, has appeared between the toner supply roller 52 and the development roller 51.

To verify the effect of the development apparatus with the structure described above, a substance charged with the prescribed negative voltage is used as the toner T supplied by the toner cartridge 25 and an experiment was executed with changes to the amount of push d and the hardness of the elastic gum material (elastic body) of the semiconductive gum layer that forms the circumferential surface of the toner supply roller 52. Specifically, as shown in chart 1, where the measurement value of the hardness of the elastic gum material of the semiconductive gum layer that forms the circumferential surface of the toner supply roller 52 is $H_{AF}$ [degree] measured by a so-called Asker F-type, the toner supply roller 52 and the development roller 51 are positioned such that the measurement value becomes $H_{AF}$=10 [degree], 20[degree], 50[degree], 80[degree], 90[degree] and, by selecting the elastic gum material forming the circumferential surface of the toner supply roller 52, the amount of push δ is set to −0.2 [mm], 0 [mm], 0.2 [mm], 0.5 [mm], 0.8 [mm], and 1.0 [mm]. The experiment was executed using the 14 patterns of A to N, shown in the same chart, with the combinations of amount of push δ and hardness $H_{AF}$ of the elastic gum material forming the circumferential surface of the toner supply roller 52 described above.

CHART 1

| | DEVELOPMENT APPARATUS STRUCTURE PATTERN | | | | | | | | | | | | | |
|---|---|---|---|---|---|---|---|---|---|---|---|---|---|---|
| | A | B | C | D | E | F | G | H | I | J | K | L | M | N |
| $H_{AF}$[degree] | 50 | 50 | 50 | 50 | 50 | 50 | 10 | 20 | 80 | 90 | 10 | 20 | 80 | 90 |
| δ [mm] | −0.2 | 0 | 0.2 | 1 | 1 | 1 | 0 | 0 | 0 | 0 | 0.5 | 0.5 | 0.5 | 0.5 |

Figure 4:
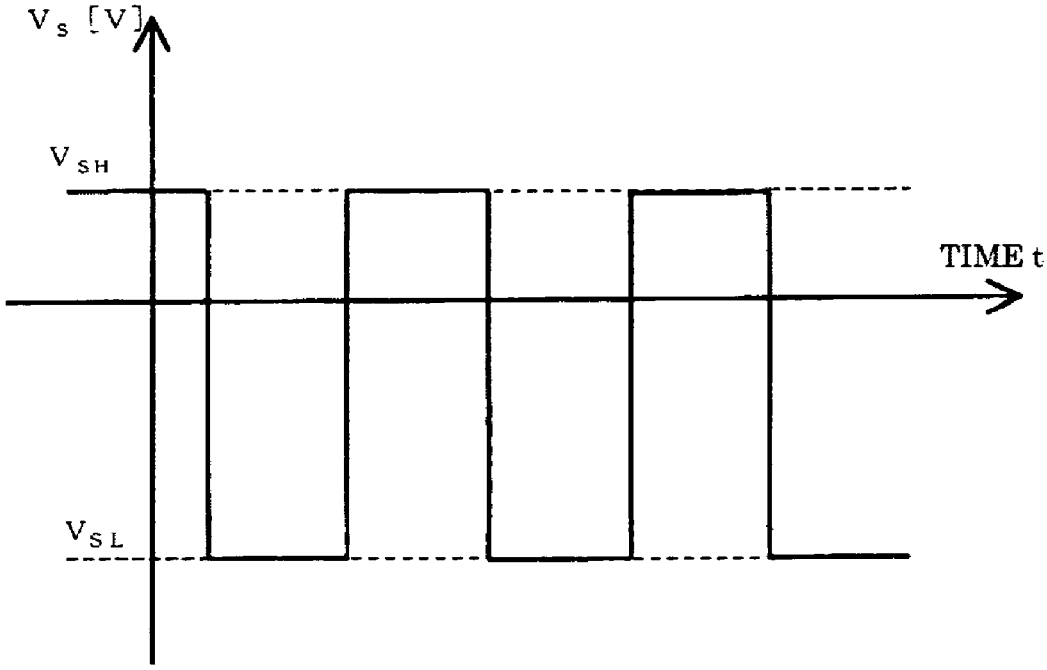
FIG. 4 is a diagram describing the wave form of the toner supply bias voltage at a time when toner with a prescribed negative charge is used in the image forming apparatus shown as the first embodiment of the present invention.

In the development apparatuses 24 that were constructed in the 14 patterns shown above, using the toner supply bias power source 55, the toner supply bias voltage with an AC current superimposed on a DC current is set as $V_S$ [V], the frequency is set as f [Hz], the large peak value with a polarity opposite to the charge polarity of the toner T is set as $V_{SH}$, and the voltage $V_{SL}$, which is a large peak value with the same polarity as the charge polarity of the toner T, is applied. To verify the effect of the development apparatuses, the values of the peak values $V_{SH}$ and $V_{SL}$ of the toner supply bias voltage $V_S$ are changed and, along with measuring the toner weight [mg/cm$^2$] of a unit of area on the development roller 51, the quality of the printing image is evaluated. In addition, the waveform of the toner supply bias voltage $V_S$, in a case where a substance charged with the prescribed negative voltage is used as the toner T supplied by the toner cartridge 25, is shown in FIG. 4.

Figure 5:
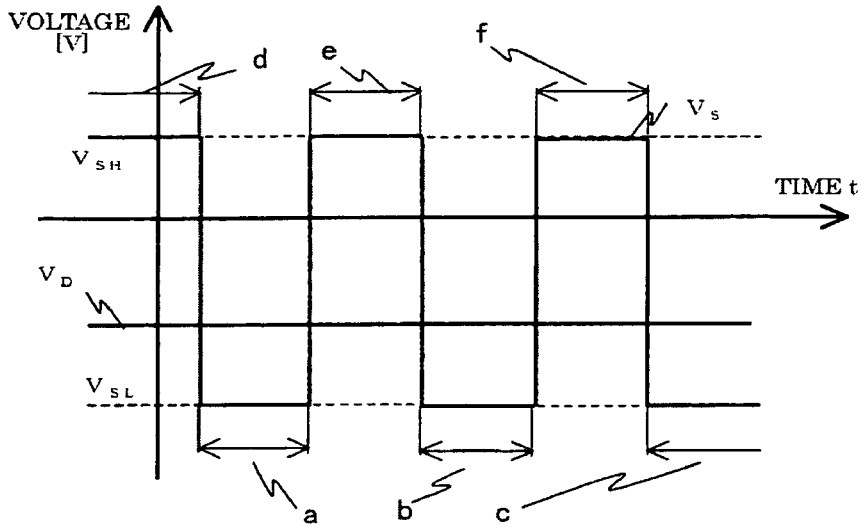
FIG. 5 is a diagram describing the wave form of the toner supply bias voltage at a time when toner with a prescribed negative charge is used and also describing the relation between the value of the development bias voltage and the value of the toner supply bias voltage at a time when the toner is pulled to the toner supply roller and removed from the circumferential surface of the development roller and at a time when the toner is moved from the toner supply roller to the development roller in the image forming apparatus shown as the first embodiment of the present invention.

Further, a development bias voltage $V_D$ is applied to the development roller 51 by the development bias power source apparatus 54. Here, a voltage of −200[V] is applied as the development bias voltage $V_D$. The toner T taken from the toner cartridge 25 into the development apparatus 24 is supplied to the development roller 51 by the toner supply roller 52. In the development apparatus 24, at the point of contact between the development roller 51 and the toner supply roller 52, at a time when the voltage value of the toner supply bias voltage $V_S$ becomes larger in the direction of the charge polarity of the toner T than the voltage value of the development bias voltage $V_D$, an electrical field attracting the toner T to the development roller 51 is formed, moving the toner T from the toner supply roller 52 to the development roller 51. In addition, the relationship between the voltage value of the development bias voltage $V_D$ and the voltage value of the toner supply bias voltage $V_S$ that moves the toner T from the toner supply roller 52 to the development roller 51, at a time when a substance charged with the prescribed negative voltage is used as the toner T supplied by the toner cartridge 25, is shown in FIG. 5. In the same diagram, the times a, b, and c where the toner supply bias voltage $V_S$ is at its peak $V_{SL}$ are times that fulfill the voltage condition to move the toner T from the toner supply roller 52 to the development roller 51.

Further, the development blade 53 thins the toner T supplied to the circumferential surface of the development roller 51. A toner layer formation bias voltage $V_{BL}$ [V] is applied to the development blade 53 by a toner layer formation bias power source apparatus 56. Here, a voltage of −200[V] is applied as the toner layer formation bias voltage $V_{BL}$. The toner supplied to the circumferential surface of the development roller 51 is charged by the toner supply roller 52, the development roller 51, and the development blade 53. The toner T that is thinned and charged on the circumferential surface of the development roller 51 is fed near the photosensitive drum 21 by the rotation of the development roller 51 and the electrostatic latent image formed on the circumferential surface of the photosensitive drum 21 is developed. Further, a portion of the toner T that is thinned and charged on the circumferential surface of the development roller 51, the portion remaining on the circumferential surface of the development roller without being used to develop the electrostatic latent image formed on the circumferential surface of the photosensitive drum 21, is attracted to the toner supply roller 52 and removed from the circumferential surface of the development roller 51. Specifically, in the development apparatus 24, at the point of contact between the development roller 51 and the toner supply roller 52, at a time when the voltage value of the toner supply bias voltage $V_S$ becomes larger in the opposite direction of the charge polarity of the toner T than the voltage value of the development bias voltage $V_D$, an electrical field attracting the toner T to the toner supply roller 52 is formed, removing the toner T from the circumferential surface of the development roller 51. In addition, the relationship between the voltage value of the development bias voltage $V_D$ and the voltage value of the toner supply bias voltage $V_S$ that removes the toner T from the circumferential surface of the development roller 51 by attracting the toner to the toner supply roller 52, at a time when a substance charged with the prescribed negative voltage is used as the toner T supplied by the toner cartridge 25, is shown in FIG. 5. In the same diagram, the times d, e, and f where the toner supply bias voltage $V_S$ is at its peak $V_{SL}$ are times that fulfill the voltage condition to remove the toner T from the circumferential surface of the development roller 51.

The following is an explanation of the results for verifying the development apparatus 24 using FIG. 6 through FIG. 11.

Figure 6:
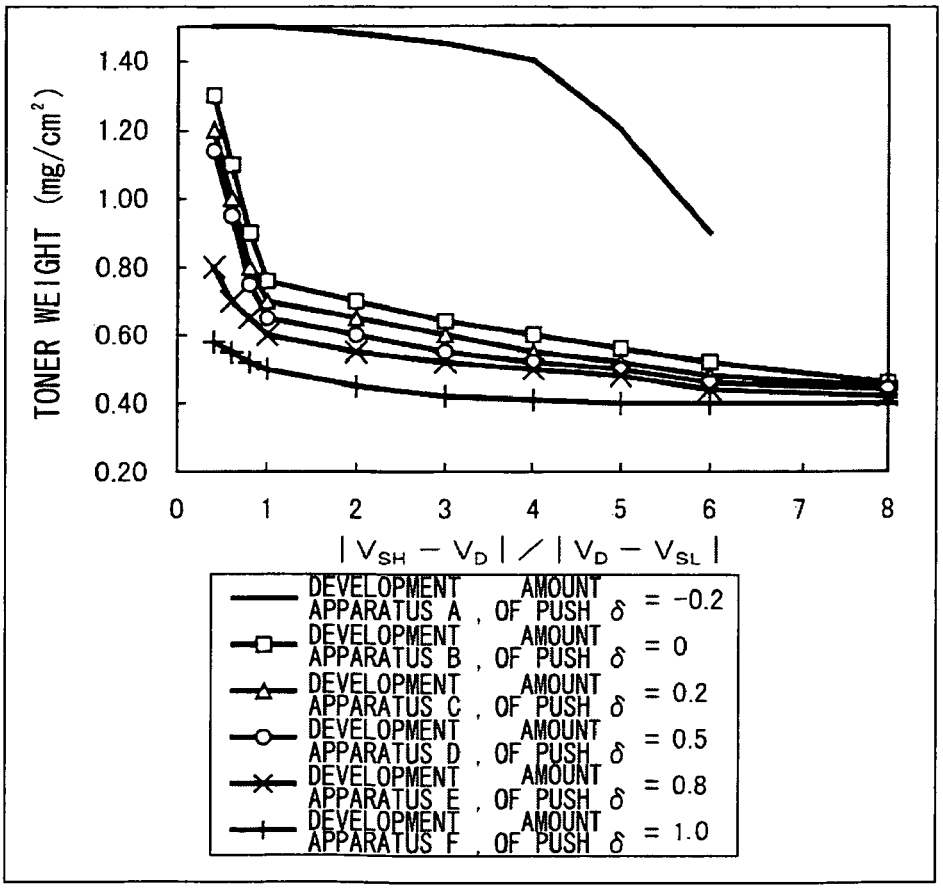
FIG. 6 is a diagram describing the results of the measurement of the toner weight on a unit of area on the circumferential surface of the development roller with the amount of push as a parameter and changing conditions for the toner supply bias voltage in the image forming apparatus shown as the first embodiment of the present invention.

First, concerning the toner weight on a unit of area on the circumferential surface of the development roller 51, the condition of the toner supply bias voltage $V_S$ was changed and the measured results are shown in FIG. 6. In addition, the toner weight on a unit of area on the circumferential surface of the development roller 51 is the weight in a unit of area of the toner T that is located on the circumferential surface of the development roller 51 in an area downstream from the development blade 53 in a direction opposite to the rotation of the development roller 51 and upstream from the location where contact is made with the photosensitive drum 21.

The image forming apparatus is stopped and the measurement of the toner weight on a unit of area on the circumferential surface of the development roller 51 is executed in a condition where each development apparatus 24 constructed with patterns A, B, C, D, E, and F have the hardness $H_{AF}$ of the elastic gum material of the semiconductive gum layer that forms the circumferential surface of the toner supply roller 52 set to $H_{AF}$=50 [degree], at a time when the image is formed on the top of the printing medium P by a dot printing process that is executed to form the printing image on A4 size paper acting as the printing medium. At this time, the frequency f of the toner supply bias voltage $V_S$ is set to f=1000 [Hz]. Here, the toner weight on a unit of area on the circumferential surface of the development roller 51 having appropriate thickness for the printing result is approximately 0.5 [mg/cm$^2$] to 0.8 [mg/cm$^2$]. In addition, the measurements are executed after 20,000 printings of the image printed with 1% of the possible number of printing dots on A4 size paper, with the settings, frequency f=1000 [Hz], the peak voltage value $V_{SH}$=−100 [V], and the peak voltage value $V_{SL}$=−300[V].

It is clear from the diagram that a larger amount of push δ leads to a lesser amount of toner weight on a unit of area on the circumferential surface of the development roller 51. This result is because a larger amount of push δ removes more of the toner T that remains on the circumferential surface of the development roller 51 without being used.

In addition, smaller values of $|V_{SH}-V_D|/|V_D-V_{SL}|$ lead to larger amounts of toner weight on a unit of area on the circumferential surface of the development roller 51 and larger values of $|V_{SH}-V_D|/|V_D-V_{SL}|$ lead to lesser amounts of toner weight. Smaller values of $|V_{SH}-V_D|/|V_D-V_{SL}|$ lead to an increase in the amount of toner T supplied because a larger electrical field is formed attracting the charged toner T to the development roller 51 from the toner supply roller 52. Larger values of $|V_{SH}-V_D|/|V_D-V_{SL}|$, on the other hand, are used to remove larger amounts of the toner T remaining on the circumferential surface of the development roller 51 because a larger electrical field is formed attracting the charged toner T to the toner supply roller 52 from the development roller 51.

The following results were obtained to verify that a difference in the amount of push d affects the toner weight on a unit of area on the circumferential surface of the development roller 51.

First, in the development apparatus 24 of pattern A constructed with the amount of push δ set to δ=−0.2 [mm], with the measured toner supply bias voltage $V_S$ spanning all conditions, the result was found to be that the toner weight on a unit of area on the circumferential surface of the development roller 51 increases beyond a suitable value. The reason for this is that the toner supply roller 52 does not contact the developer roller 51 and therefore an insufficient amount of toner, remaining on the circumferential surface of the development roller without being used, is removed.

In addition, in the development apparatuses 24 of patterns B and C constructed with the amount of push δ set to δ=0, 0.2 [mm] respectively, with voltage in the range of $1 \leqq |V_{SH}-V_D|/|V_D-V_{SL}| \leqq 6$, the toner weight on a unit of area on the circumferential surface of the development roller 51 becomes a suitable value. Further, in the development apparatus 24 of pattern D constructed with the amount of push δ set to δ=0.5 [mm], with voltage in the range of $1 \leqq |V_{SH}-V_D|/|V_D-V_{SL}| \leqq 5$, the toner weight on a unit of area on the circumferential surface of the development roller 51 becomes a suitable value. In the development apparatus 24 of pattern E constructed with the amount of push δ set to δ=0.8 [mm], with voltage in the range of $0.5 \leqq |V_{SH}-V_D|/|V_D-V_{SL}| \leqq 3$, the toner weight on a unit of area on the circumferential surface of the development roller 51 becomes a suitable value. In the development apparatus 24 of pattern F constructed with the amount of push δ set to δ=1.0 [mm], with voltage in the range of $|V_{SH}-V_D|/|V_D-V_{SL}| \leqq 1$, the toner weight on a unit of area on the circumferential surface of the development roller 51 decreases below a suitable value.

The hardness $H_{AF}$ of the elastic gum material of the semiconductive gum layer that forms the circumferential surface of the toner supply roller 52, in a case where the development apparatus 24 is set to $H_{AF}$=50 [degree], depends on the amount of push δ. In a case where $|V_{SH}-V_D|/|V_D-V_{SL}|<1$, the toner weight on a unit of area on the circumferential surface of the development roller 51 increases beyond a suitable value and, in a case where $|V_{SH}-V_D|/|V_D-V_{SL}|>5$, the toner weight decreases below a suitable value, so that, from the viewpoint of the printing result, instances arise where a suitable thickness cannot be achieved. Accordingly, in the situation described above, it is necessary at least to set the toner supply bias voltage $V_S$ in the range of $1 \leqq |V_{SH}-V_D|/|V_D-V_{SL}| \leqq 5$. In addition, to set the toner supply bias voltage $V_S$ in the range of $1 \leqq |V_{SH}-V_D|/|V_D-V_{SL}| \leqq 5$, it is necessary to have the toner supply roller 52 and the development roller 51 in direct contact and to set the amount of push δ to 0.5 [mm] or below. In other words, it is necessary to set the toner supply bias voltage $V_S$ in the range of $1 \leqq |V_{SH}-V_D|/|V_D-V_{SL}| \leqq 5$ and the amount of push δ between 0 [mm] and 0.5 [mm].

Figure 7:
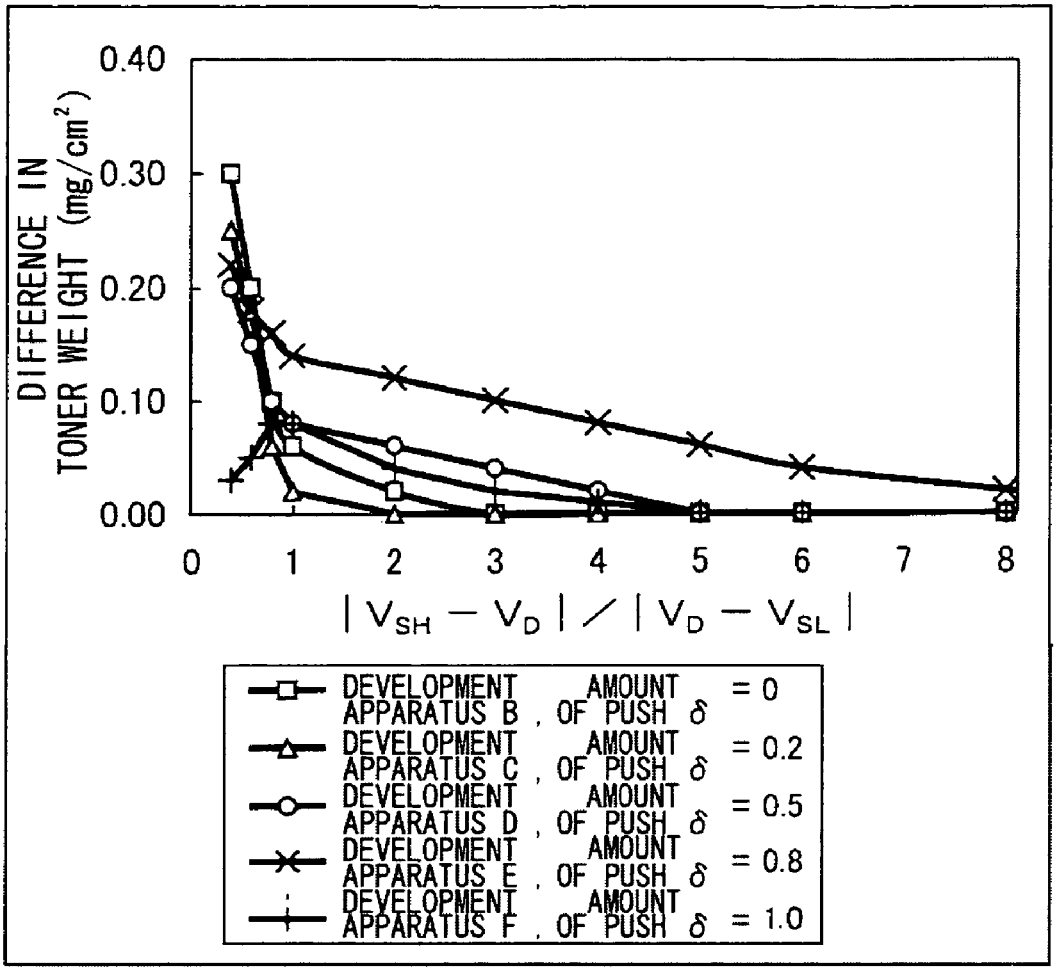
FIG. 7 is a diagram describing the results of the measurement of the difference between the toner weight on a unit of area on the circumferential surface of the development roller when the image is formed at the top of the printing medium and the toner weight on a unit of area on the circumferential surface of the development roller when the image is formed at the bottom of the printing medium, with the amount of push as a parameter and changing conditions for the toner supply bias voltage in the image forming apparatus shown as the first embodiment of the present invention.

Next, concerning the development apparatuses 24 constructed with patterns B, C, D, E, and F, FIG. 7 shows the results verifying the difference in thickness of the image at the top and bottom of the printing medium P.

The image forming apparatus is stopped and the measurement concerning the development apparatuses 24 constructed with patterns B, C, D, E, and F, at a time when the image is formed on the top of the printing medium P by a dot printing process that is executed to form the printing image on A4 size paper acting as the printing medium, is executed in a manner such that the toner weight on a unit of area on the circumferential surface of the development roller 51 is measured and the difference of the measurement result at the time of the formation of the image at the top of the printing medium P shown in FIG. 6 is sought. In addition, as described above, the toner weight on a unit of area on the circumferential surface of the development roller 51 is the weight in a unit of area of the toner T that is located on the circumferential surface of the development roller 51 in an area downstream from the development blade 53 in a direction opposite to the rotation of the development roller 51 and upstream from the location where contact is made with the photosensitive drum 21. At this time, the frequency of the toner supply bias voltage $V_S$ is set to f=1000 [Hz].

In the same manner as the measurements shown in FIG. 6, the measurements of each development apparatus 24 constructed with patterns B, C, D, E, and F, are executed after 20,000 printings of the image printed with 1% of the possible number of printing dots on A4 size paper, with the settings, frequency f=1000 [Hz], the peak voltage value $V_{SH}$=−100 [V], and the peak voltage value $V_{SL}$=−300 [V]. Here, from the perspective of the printing result, the thickness is sufficiently thin where the difference in toner weight on a unit of area on the circumferential surface of the development roller 51 for a satisfactory printing image is approximately between 0.1 [mg/cm$^2$] and 0 [mg/cm$^2$].

It is clear from the same diagram that, in the development apparatuses 24 constructed with patterns B, C, D, E, and F, smaller values of $|V_{SH}-V_D|/|V_D-V_{SL}|$ lead to a larger difference in the toner weight. It is understood from the measurement result of FIG. 6 that the larger amount of toner in the toner layer formed on the circumferential surface of the development roller 51 at a time when the image is formed at the top of the printing medium P is because the supply of toner from the toner supply roller 52 cannot keep pace at a time when the image is formed at the bottom of the printing medium P. This phenomenon is especially prominent where the value of $|V_{SH}-V_D|/|V_D-V_{SL}|$ is below 1. On the other hand, in the development apparatus 24 constructed with pattern F, the difference in toner weight is small at a time when the image is formed at either the top or bottom of the printing medium P because there is a small amount of toner on a unit of area on the circumferential surface of the development roller 51.

Further, upon comparing the development apparatus constructed with pattern B and the development apparatus constructed with pattern C, in the development apparatus constructed with pattern B, the large toner weight on a unit of area on the circumferential surface of the development roller 51 for forming the image on the top of the printing medium P causes a slight shortage in the supply of toner supplied by the toner supply roller 52 for forming the image at the bottom of the printing medium P, resulting in the difference in toner weight becoming larger for the development apparatus 24 constructed with pattern C. It should be noted that the difference of toner weight where $|V_{SH}-V_D|/|V_D-V_{SL}| \leqq 1$ is below 1 [mg/cm$^2$] and does not affect the printing result.

In addition, upon comparison of the development apparatuses constructed with patterns C, D, and E, it was found that a larger amount of push δ leads to a larger difference in toner weight. In other words, on the entire printing medium P, at the time when the image is formed on either the top or the bottom of the printing medium P, a larger amount of push δ, increases the amount of toner removed from the circumferential surface of the development roller 51 by the toner supply roller 52. On the other hand, at a time when the image is formed on the top of the printing medium P, since a relatively large amount of toner T is supplied, there is an increase in the difference of toner weight on a unit of area on the circumferential surface of the development roller 51. It should be noted that, where the amount of push d is between 0 [mm] and 0.5 [mm] and $|V_{SH}-V_D|/|V_D-V_{SL}| \geqq 1$, the difference in toner weight is below 1 [mg/cm$^2$] and does not affect the printing result. That is, from the perspective of the difference of thickness, in the same manner as the measurement results shown in FIG. 6, if the toner supply bias voltage $V_S$ is in the range of $1 \leqq |V_{SH}-V_D|/|V_D-V_{SL}| \leqq 5$ and the amount of push δ is between 0 [mm] and 0.5 [mm], a suitable printing result can be achieved.

Figure 8:
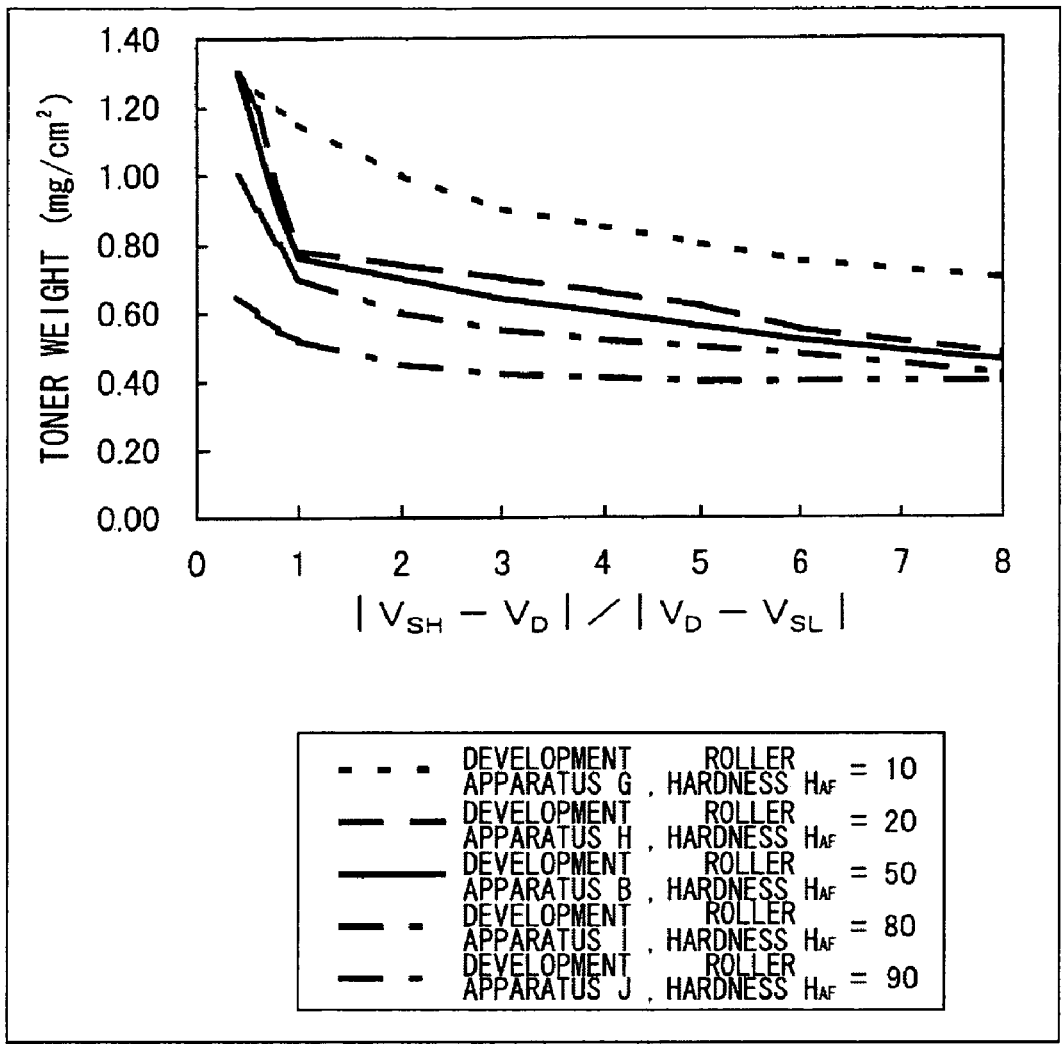
FIG. 8 is a diagram describing the results of the measurement of the toner weight on a unit of area on the circumferential surface of the development roller with the hardness of the toner supply roller as a parameter and changing conditions for the toner supply bias voltage in the image forming apparatus shown as the first embodiment of the present invention.

Next, to verify the relation between the print thickness and the hardness $H_{AF}$ of the elastic gum material forming the circumferential surface of the toner supply roller 52 in a condition where the amount of push δ=0 [mm], using the same measurement conditions as the measurements shown in FIG. 6, the toner weight on a unit of area on the circumferential surface of the development roller 51 at a time when the image is formed at the top of the printing medium P was measured in the development apparatuses 24 constructed with patterns B, G, H, I, and J. The results are shown in FIG. 8.

It is clear from the same diagram that larger values of the hardness $H_{AF}$ of the elastic gum material forming the circumferential surface of the toner supply roller 52 lead to smaller amounts of toner weight on a unit of area on the circumferential surface of the development roller 51, because larger values of hardness $H_{AF}$ cause the toner supply roller 52 to remove more toner T from the circumferential surface of the development roller 51. In the development units 24 constructed with patterns B, H, I, and J, having hardness $H_{AF}$=50, 20, 80, and with a voltage range of $1 \leqq |V_{SH}-V_D|/|V_D-V_{SL}| \leqq 5$, the toner weight on a unit of area on the circumferential surface of the development roller 51 becomes a suitable amount (0.5 [mg/cm$^2$]~0.8 [mg/cm$^2$]).

Figure 9:
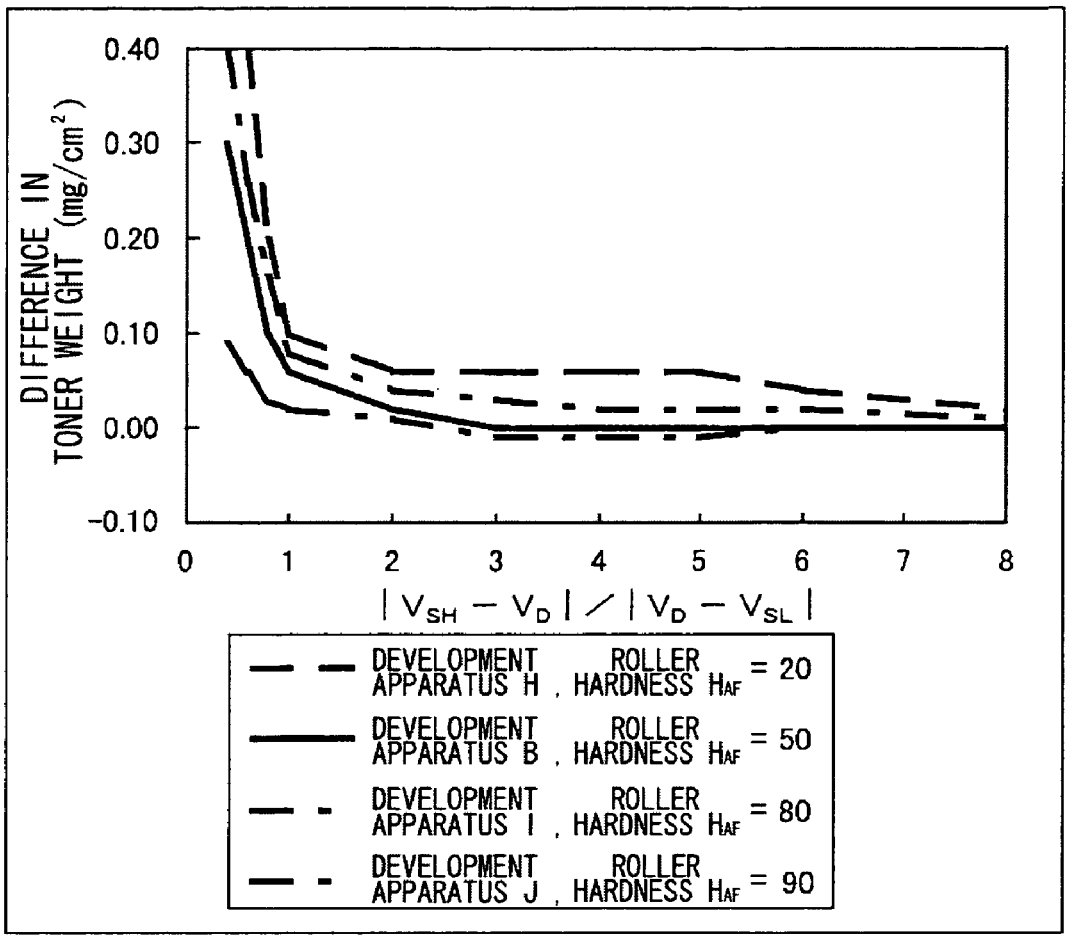
FIG. 9 is a diagram describing the results of the measurement of the difference between the toner weight on a unit of area on the circumferential surface of the development roller when the image is formed at the top of the printing medium and the toner weight on a unit of area on the circumferential surface of the development roller when the image is formed at the bottom of the printing medium, with the hardness of the toner supply roller as a parameter and changing conditions for the toner supply bias voltage in the image forming apparatus shown as the first embodiment of the present invention.

To verify the relation between the hardness $H_{AF}$ of the elastic gum material forming the circumferential surface of the toner supply roller 52 and the difference in thickness of the image at the top and bottom of the printing medium P, in a condition where the amount of push δ=0 [mm], using the same measurement conditions as the measurements shown in FIG. 6, the difference between the toner weight on a unit of area on the circumferential surface of the development roller 51 at a time when the image is formed at the top of the printing medium P and the toner weight on a unit of area on the circumferential surface of the development roller 51 at a time when the image is formed at the bottom of the printing medium P, was measured in the development apparatuses 24 constructed with patterns B, H, I, and J. The results are shown in FIG. 9.

It is clear from the same diagram that larger values of the hardness $H_{AF}$ of the elastic gum material forming the circumferential surface of the toner supply roller 52 lead to a smaller difference in the toner weight on a unit of area on the circumferential surface of the development roller 51. In addition, in each of the development apparatuses 24 constructed with patterns B, H, I, and J, the difference in toner weight is within a suitable range (below 0.1 [mg/cm$^2$]). It should be noted that in the development apparatus 24 constructed with pattern J, which has the largest hardness $H_{AF}$ value, there is a small amount of toner weight on a unit of area on the circumferential surface of the development roller 51, causing thinness beyond the suitable range in the image printed on the printing medium P. Although not shown, the same measurement was executed for the development apparatus 24 constructed with pattern G with hardness $H_{AF}$=10. In this case, there is a large difference in toner weight and also a large difference in thickness between the top and bottom of the printing medium P. This is because, as shown in FIG. 7, there is a large amount of toner in the toner layer formed on the circumferential surface of the development roller 51 at a time when the image is formed at the top of the printing medium P, and the supply of toner from the toner supply roller 52 cannot keep pace at a time when the image is formed at the bottom of the printing medium P.

In a case where the development apparatus has the amount of push δ=0 [mm], favorable results are achieved that the image is of an appropriate thickness and there is little difference in the thickness spanning the entire printing medium P, if the hardness $H_{AF}$ of the elastic gum material of the semiconductive gum layer forming the circumferential surface of the toner supply roller 52 is $20 \leqq H_{AF} \leqq 80$.

Figure 10:
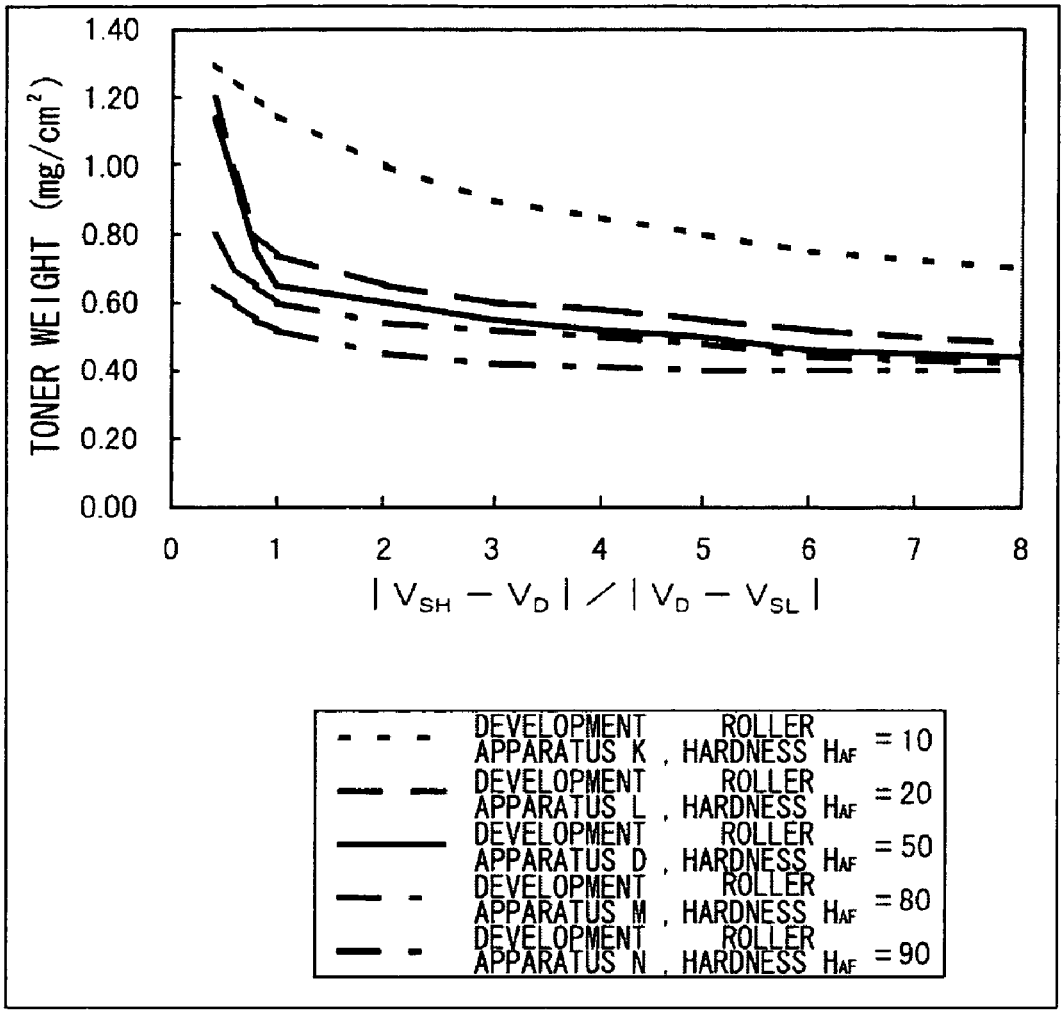
FIG. 10 is a diagram describing the results of the measurement of the toner weight on a unit of area on the circumferential surface of the development roller with the hardness of the toner supply roller as a parameter and changing conditions for the toner supply bias voltage and also describing the results of the measurements shown in FIG. 8 conducted with a different amount of push in the image forming apparatus shown as the first embodiment of the present invention.

In the same manner, to verify the relation between the print thickness and the hardness $H_{AF}$ of the elastic gum material forming the circumferential surface of the toner supply roller 52 in a condition where the amount of push δ=0 [mm], using the same measurement conditions as the measurements shown in FIG. 6, the toner weight on a unit of area on the circumferential surface of the development roller 51 at a time when the image is formed at the top of the printing medium P was measured in the development apparatuses 24 constructed with patterns D, K, L, M, and N. The results are shown in FIG. 10.

It is clear from the same diagram that, in the same manner as the case where the amount of push δ=0 [mm], larger values of the hardness $H_{AF}$ of the elastic gum material forming the circumferential surface of the toner supply roller 52 lead to a smaller amount of toner weight on a unit of area on the circumferential surface of the development roller 51. This is because, as described above, larger values of hardness $H_{AF}$ cause the toner supply roller 52 to remove more toner T from the circumferential surface of the development roller 51. In the development units 24 constructed with patterns D, L, and M, having hardness $H_{AF}$=50, 20, 80, and with a voltage range of $1 \leqq |V_{SH}-V_D|/|V_D-V_{SL}| \leqq 5$, the toner weight on a unit of area on the circumferential surface of the development roller 51 becomes a suitable amount (0.5 [mg/cm$^2$]~0.8 [mg/Cm$^2$]).

Figure 11:
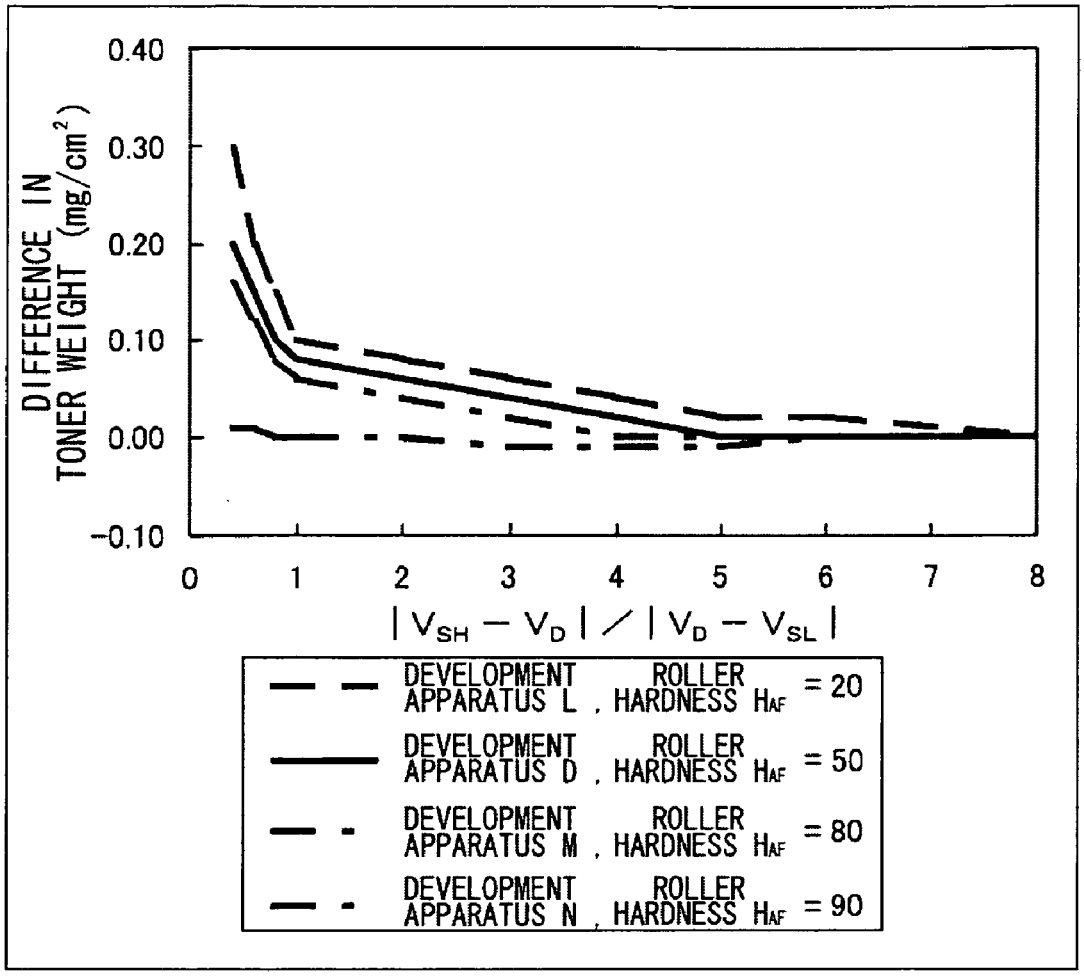
FIG. 11 is a diagram describing the results of the measurement of the difference between the toner weight on a unit of area on the circumferential surface of the development roller when the image is formed at the top of the printing medium and the toner weight on a unit of area on the circumferential surface of the development roller when the image is formed at the bottom of the printing medium, with the hardness of the toner supply roller as a parameter and changing conditions for the toner supply bias voltage and also describing the results of the measurements shown in FIG. 9 conducted with a different amount of push in the image forming apparatus shown as the first embodiment of the present invention.

To verify the relation between the hardness $H_{AF}$ of the elastic gum material forming the circumferential surface of the toner supply roller 52 and the difference in thickness of the image at the top and bottom of the printing medium P, in a condition where the amount of push δ=0.5 [mm], using the same measurement conditions as the measurements shown in FIG. 6, the difference between the toner weight on a unit of area on the circumferential surface of the development roller 51 at a time when the image is formed at the top of the printing medium P and the toner weight on a unit of area on the circumferential surface of the development roller 51 at a time when the image is formed at the bottom of the printing medium P, was measured in the development apparatuses 24 constructed with patterns D, L, M, and N. The results are shown in FIG. 11.

It is clear from the same diagram that, in the same manner as the case where the amount of push δ=0.5 [mm], larger values of the hardness $H_{AF}$ of the elastic gum material forming the circumferential surface of the toner supply roller 52 lead to a smaller difference in the toner weight on a unit of area on the circumferential surface of the development roller 51. In addition, In addition, in each of the development apparatuses 24 constructed with patterns D, L, M, and N, the difference in toner weight is within a suitable range (below 0.1 [mg/cm$^2$]). It should be noted that in the development apparatus 24 constructed with pattern N, which has the largest hardness $H_{AF}$ value, there is a small amount of toner weight on a unit of area on the circumferential surface of the development roller 51, causing thinness beyond the suitable range in the image printed on the printing medium P. Although not shown, the same measurement was executed for the development apparatus 24 constructed with pattern K with hardness $H_{AF}$=10. In this case, there is a large difference in toner weight and also a large difference in thickness between the top and bottom of the printing medium R This is because, in the same manner as the development apparatus 24 constructed with pattern G having hardness $H_{AF}$=10 and amount of push 6=0 [mm], there is a large amount of toner in the toner layer formed on the circumferential surface of the development roller 51 at a time when the image is formed at the top of the printing medium P, and the supply of toner from the toner supply roller 52 cannot keep pace at a time when the image is formed at the bottom of the printing medium P.

In a case where the development apparatus has the amount of push δ=0.5 [mm], favorable results are achieved that the image is of an appropriate thickness and there is little difference in the thickness spanning the entire printing medium P, if the hardness $H_{AF}$ of the elastic gum material of the semi-conductive gum layer forming the circumferential surface of the toner supply roller 52 is $20 \leqq H_{AF} \leqq 80$.

The frequency f [Hz] of the toner supply bias voltage $V_S$ was changed and the quality of the printed image was evaluated for the development apparatuses constructed with patterns B, C, D, H, I, L, and M under the condition that $1 \leqq |V_{SH}-V_D|/|V_D-V_{SL}| \leqq 5$. The evaluation was executed by printing an image, which can be printed entirely by dots on A4 size paper, on the printing medium P after 20,000 printings of the image printed with 1% of the possible number of printing dots on A4 size paper.

The result, in a case where the frequency f of the toner supply bias voltage $V_S$ is below 500 [Hz], is that, in the development apparatuses 24 constructed with patterns B, C, D, H, I, L, and M, periodic horizontal stripes are observed lateral to the printing medium P, that is, perpendicular to the feeding direction of the printing medium P. As described above, at a time when the voltage value of the toner supply bias voltage $V_S$ becomes larger in the direction of the charge polarity of the toner T than the voltage value of the development bias voltage $V_D$, an electrical field attracting the toner T to the development roller 51 from the toner supply roller 52 is formed, increasing the amount of toner T supplied to the development roller 51. On the other hand, at a time when the voltage value of the toner supply bias voltage $V_S$ becomes smaller in the direction of the charge polarity of the toner T than the voltage value of the development bias voltage $V_D$, an electrical field attracting the toner T to the toner supply roller 52 from the development roller 51 is formed, decreasing the amount of toner T supplied to the development roller 51. In other words, in the development apparatus 24, the amount of toner T supplied to the circumferential surface of the development roller 51 increases and decreases according to the cycle of the AC voltage component of the toner supply bias voltage $V_S$. Lower frequencies f of the toner supply bias voltage $V_S$ lead to a lengthening of the cycle of increasing and decreasing of the amount of toner T supplied to the circumferential surface of the development roller 51, and it is observed that the distribution of the toner T causes horizontal stripes, and a decrease in the quality of the printing image. From the result of the combined evaluations conducted with large values of frequency f of the toner supply bias voltage $V_S$, it is recognized that the printing image with good quality can be achieved if $f \geqq 500$.

In a case where the frequency f of the toner supply bias voltage $V_S$ is higher than 5000 [Hz] in the development apparatuses 24 constructed with patterns B, C, D, H, I, L, and M, the level of thickness of the image formed at the top of the printing medium P is high but, on the other hand, friction arises in the image formed at the bottom and a printing image with good quality cannot be achieved. This is because there is an excessive amount of toner T supplied from the toner supply roller 52 at the beginning of the image forming operation corresponding to the formation of the image at the top of the printing medium P, so that a stable supply of toner cannot be supplied to the circumferential surface of the development roller 51, causing a lack of toner T necessary to form the image at the bottom of the printing medium R In a case where $f>5000$, the movement of the toner T cannot keep pace with the change in the AC voltage component of the toner supply bias voltage $V_S$, and therefore toner can neither be supplied to or removed from the circumferential surface of the development roller 51. From the result of the combined evaluations conducted with small values of frequency f of the toner supply bias voltage $V_S$, it is recognized that the printing image with good quality can be achieved if $f \leqq 5000$.

From the measurements and evaluation results described above, in the development apparatus 24, formation of a high quality printing image can be achieved in a condition where, from the peak values [V] of the toner supply bias voltage $V_S$ applied to the toner supply roller 52, with $V_{SH}$ as the large peak value having polarity in a direction opposite to the charge of the toner T, and $V_{SL}$ as the large peak value having polarity in the same direction as that of the charge of the toner T, using the development bias voltage $V_D$ applied to the development roller 51, the voltage is set to $1 \leqq |V_{SH}-V_D|/|V_D-V_{SL}| \leqq 5$, the hardness $H_{AF}$ of the elastic body forming the circumferential surface of the toner supply roller 52 is set to $20 \leqq H_{AF} \leqq 80$, the toner supply roller 52 is disposed to contact the development roller 51 with an amount of push 6 of 0.5 [mm] or below, and the frequency f [Hz] of the of the toner supply bias voltage $V_S$ is set to $500 \leqq f \leqq 5000$.

The image forming apparatus shown as the first embodiment of the present invention, by containing the development apparatus 24 with the conditions described above, can prevent deterioration of the toner T, toner supply roller 52, and development roller 51 caused by friction between the toner supply roller 52 and the development roller 51 and can provide a constant supply of toner T that has been charged and thinned to a uniform thickness, resulting in the ability to quickly form high quality printing material. In addition, in the image forming apparatus, compared to an image forming apparatus containing a conventional development apparatus, the amount of torque necessary to drive the rotation of the development roller 51 and the toner supply roller 52 can be lowered and a decrease in the quality of the printing material can be prevented, even in a case where the operation is performed quickly.

Next, the image forming apparatus shown as the second embodiment will be described.

The image forming apparatus shown as the second embodiment is an upgrade of the image forming apparatus shown as the first embodiment and has a different method for applying the toner supply bias voltage to the toner supply roller in the development apparatus. In the description of the second embodiment, the same numbers will be used for components described in the first embodiment and a detailed explanation will be omitted.

The image forming apparatus contains the development apparatus 24 having the same structure as the development apparatus 24 previously shown in FIG. 1 and FIG. 2.

In the image forming apparatus shown as the first embodiment, to achieve sufficient effect from the development apparatus 24, it is necessary to have a large peak value of the AC voltage component of the toner supply bias voltage $V_S$ with a polarity opposite to the charge polarity of the toner T. Therefore, in the image forming apparatus shown as the first embodiment, from the toner T thinned on the circumferential surface of the development roller 51, the toner T charged with reverse polarity greatly increases by applying a large voltage with a polarity opposite to the charge polarity of the toner T and, as a result, the toner T charged with reverse polarity is affixed to a non-image portion to which the toner T should not be affixed, causing fog that dirties the printing image.

In the image forming apparatus shown as the second embodiment, there is a different method for applying the toner supply bias voltage $V_S$ to the toner supply roller 52.

Figure 12:
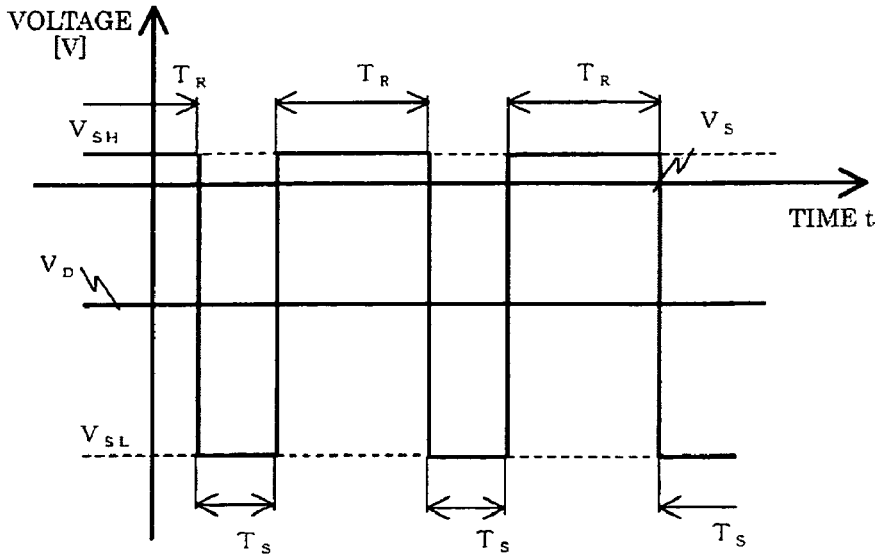
FIG. 12 is a diagram describing the wave form of the toner supply bias voltage at a time when toner with a prescribed negative charge is used in the image forming apparatus shown as the second embodiment of the present invention.

The waveform of the toner supply bias voltage $V_S$ is shown in FIG. 12. The toner supply bias voltage $V_S$, as described above, is an oscillating voltage with an AC voltage superimposed on a prescribed DC voltage, with $V_{SH}$ set as the large peak value having polarity in a direction opposite to the charge of the toner T, and $V_{SL}$ set as the large peak value having polarity in the same direction as that of the charge of the toner T. Here, the relation between the development bias voltage $V_D$ and the toner supply bias voltage $V_S$ is measured with the time at which $V_{SL}<V_S<V_D$ set as $T_S$ and the time at which $V_D<V_S<V_{SH}$ set as $T_R$. In the image forming apparatus shown as the second embodiment, by setting the times $T_R$ and $T_S$ to a prescribed value, even if the amplitude of the AC voltage component of the toner supply bias voltage $V_S$ is small, a sufficient effect from equipping the development apparatus 24 can be achieved.

As described in the first embodiment, in the development apparatus 24, the toner T is supplied to the development roller 51 from the toner supply roller 52. In addition, the portion of the toner T that is thinned and charged on the circumferential surface of the development roller 51, the portion remaining on the circumferential surface of the development roller without being used to develop the electrostatic latent image formed on the circumferential surface of the photosensitive drum 21, is attracted to the toner supply roller 52 and removed from the circumferential surface of the development roller 51. In the development apparatus 24, at the point of contact between the development roller 51 and the toner supply roller 52, at a time when the voltage value of the toner supply bias voltage $V_S$ becomes larger in the direction of the charge polarity of the toner T than the voltage value of the development bias voltage $V_D$, an electrical field attracting the toner T to the development roller 51 is formed, moving the toner T from the toner supply roller 52 to the development roller 51. On the other hand, at the point of contact between the development roller 51 and the toner supply roller 52, at a time when the voltage value of the toner supply bias voltage $V_S$ becomes larger in the opposite direction of the charge polarity of the toner T than the voltage value of the development bias voltage $V_D$, an electrical field attracting the toner T to the toner supply roller 52 is formed, removing the toner T from the circumferential surface of the development roller 51. Accordingly, in the development apparatus 24, in a case where there is a large value for the time $T_R$, the amount of the toner T supplied to the development roller 51 greatly increases, increasing the amount of toner on the circumferential surface of the development roller 51. On the other hand, in a case where there is a large value for the time $T_S$, the amount of toner T removed from the circumferential surface of the development roller 51 greatly increases, decreasing the amount of toner on the on the circumferential surface of the development roller 51.

In the image forming apparatus shown as the first embodiment, problems of a conventional image forming apparatus can be solved by changing the waveform of the AC voltage superimposed on the toner bias voltage $V_S$ is changed and by setting the peak values of the toner supply bias voltage $V_S$, $V_{SH}$ and $V_{SL}$, to prescribed values. In the image forming apparatus shown as the second embodiment, the problems of a conventional image forming apparatus can be solved by changing the waveform of the AC voltage superimposed on the toner bias voltage $V_S$ and by setting the times $T_R$ and $T_S$ to prescribed values.

Figure 13:
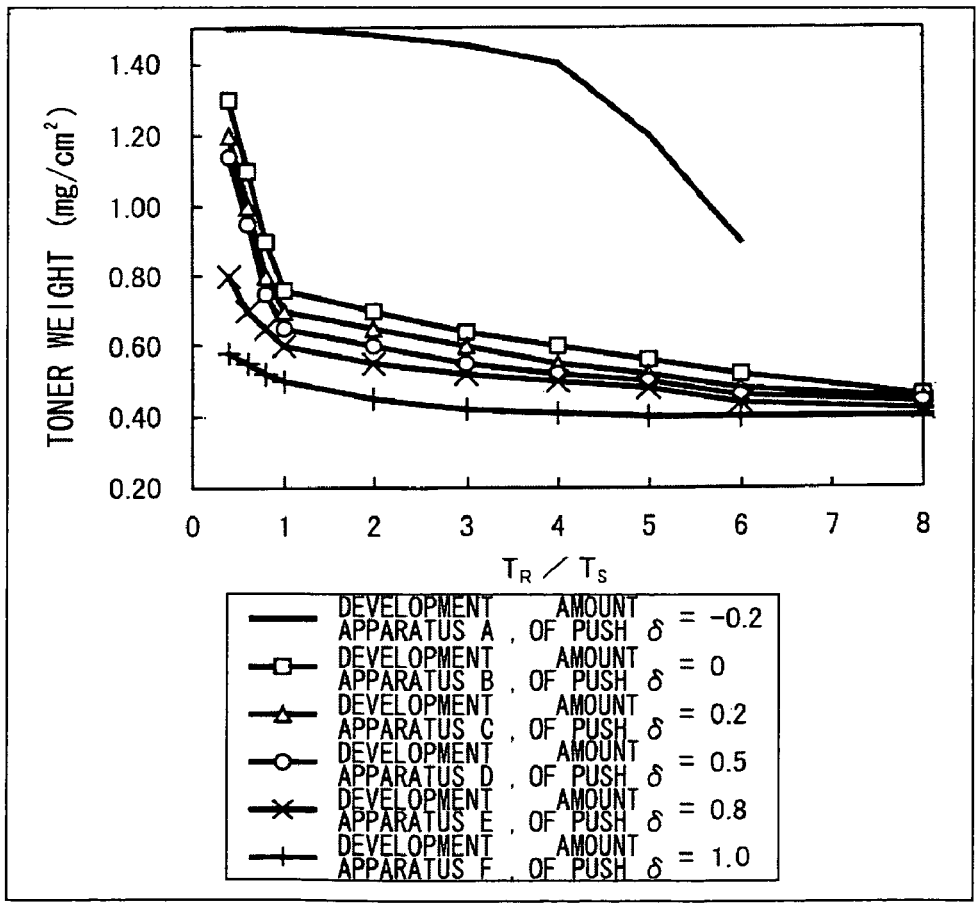
FIG. 13 is a diagram describing the results of the measurement of the toner weight on a unit of area on the circumferential surface of the development roller with the amount of push as a parameter and changing conditions for the toner supply bias voltage in the image forming apparatus shown as the second embodiment of the present invention.

The ratio $T_R/T_S$ of the times $T_R$ and $T_S$ of the toner supply bias voltage $V_S$ is changed and, in the same manner as the measurements shown in FIG. 6, the toner weight on a unit of area on the circumferential surface of the development roller 51 is measured. The results are shown in FIG. 13. In addition, the toner weight on a unit of area on the circumferential surface of the development roller 51 is the weight in a unit of area of the toner T that is located on the circumferential surface of the development roller 51 in an area downstream from the development blade 53 in a direction opposite to the rotation of the development roller 51 and upstream from the location where contact is made with the photosensitive drum 21.

The image forming apparatus is stopped and the measurement of the toner weight on a unit of area on the circumferential surface of the development roller 51 is executed in a condition where each development apparatus 24 constructed with patterns A, B, C, D, E, and F have the hardness $H_{AF}$ of the elastic gum material of the semiconductive gum layer that forms the circumferential surface of the toner supply roller 52 set to $H_{AF}$=50 [degree], at a time when the image is formed on the top of the printing medium P by a dot printing process that is executed to form the printing image on A4 size paper acting as the printing medium. At this time, the development bias voltage $V_D$ is set to −200[V] and the toner supply bias voltage $V_S$ is set to frequency f=1000 [Hz], peak value $V_{SH}$=−10[V], and peak value $V_{SL}$=−300[V]. In addition, the measurements are executed after 20,000 printings of the image printed with 1% of the possible number of printing dots on A4 size paper, with the toner supply bias voltage $V_S$ set to frequency f=1000 [Hz], peak value $V_{SH}$=−100[V], and peak value $V_{SL}$=−300 [V].

As shown in FIG. 13, the results of the measurements are the same as the measurement results previously shown in FIG. 6, showing that a favorable printing result can be achieved if at least the toner supply bias voltage $V_S$ is within the range $1 \leqq T_R/T_S \leqq 5$ and the amount of push δ is 0.5 [mm] or below.

In other words, in the image forming apparatus shown as the first embodiment, the amount of toner on the circumferential surface of the development roller 51 can be set to a precise value by setting a prescribed value for the ratio of the strength of the electrical field supplying the toner T to the development roller 51 and the strength of the electrical field removing the toner T from the circumferential surface of the development roller 51. In the image forming apparatus shown as the second embodiment, the amount of toner on the circumferential surface of the development roller 51 can be set to a precise value by setting a prescribed value for the ratio of the time at which the electrical field supplying the toner T to the development roller 51 is formed and the time at which the electrical field removing the toner T from the circumferential surface of the development roller 51 is formed.

In addition, in the same manner as the evaluations and measurements shown in FIG. 7 through FIG. 11, the applicant changed the $T_R$ and $T_S$ ratio $T_R/T_S$ of the toner supply bias voltage $V_S$ and conducted evaluation of the quality of the printing image and measurement of the toner weight and difference of toner weight using the hardness $H_{AF}$ and amount of push δ of the toner supply roller 52 as parameters. The results of these evaluations and measurements, not shown, are the same as those of FIG. 7 through FIG. 11.

From the measurement and evaluation results described above, it is recognized that a high quality image can be achieved by the development unit 24 in a condition where the hardness $H_{AF}$ of the elastic body forming the circumferential surface of the toner supply roller 52 is set to $20 \leqq H_{AF} \leqq 80$, the toner supply roller 52 is disposed to contact the development roller 51 with an amount of push δ of 0.5 [mm] or below, the frequency f [Hz] of the of the toner supply bias voltage $V_S$ is set to $500 \leqq f \leqq 5000$ at a time when the toner supply bias voltage $V_S$, which is an AC voltage superimposed on a DC voltage, is applied to the toner supply roller 52, and $1 \leqq T_R/T_S \leqq 5$ at a time when the peak values [V] of the toner supply bias voltage $V_S$ applied to the toner supply roller 52 are set so that $V_{SH}$ is the large peak value having polarity in a direction opposite to the charge of the toner T and $V_{SL}$ as the large peak value having polarity in the same direction as that of the charge of the toner T and the relation between the toner supply bias voltage $V_S$ and the development bias voltage $V_D$ is set as $T_S$ at a time when $V_{SL}<V_S<V_D$ and as $T_R$ at a time when $V_D<V_S<V_{SH}$.

The image forming apparatus shown as the second embodiment of the present invention, by containing the development apparatus 24 with the conditions described above, can prevent fog arising from the toner T charged with reverse polarity, caused by large peak values of the AC voltage component of the toner supply bias voltage $V_S$ with polarity opposite to the charge polarity of the toner T, even if the amplitude of the AC voltage component of the toner supply bias voltage $V_S$ is small, since the effect described in the first embodiment can sufficiently be achieved.

Figure 14:
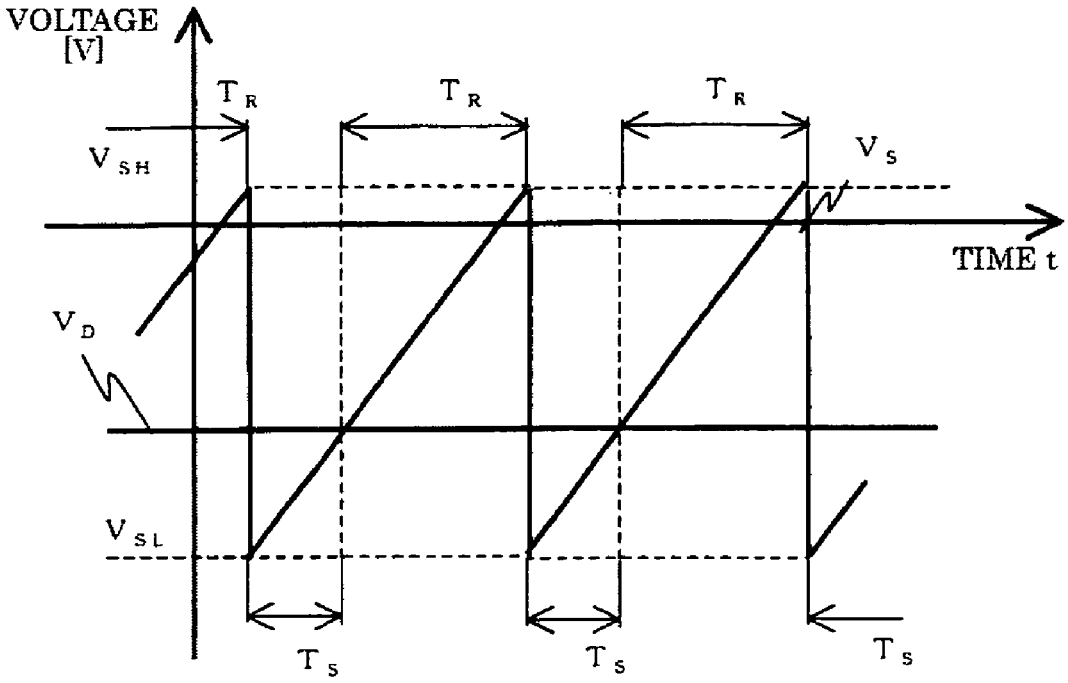
FIG. 14 is a diagram describing the wave form of the toner supply bias voltage that is different from the wave form shown in FIG. 12.

The present invention is not limited to the embodiments described above. For example, as shown in FIG. 4 and FIG. 12, the aforementioned embodiments are described as applying to the toner supply roller the toner supply bias voltage that changes the waveform of the AC voltage to a rectangular wave over time, but, as shown in FIG. 14, the present invention may apply to the toner supply roller the toner supply bias voltage that that changes the waveform of the AC voltage to a triangular wave over time.

In addition, the aforementioned embodiments are described as using the image forming apparatus to form a color image, but the present invention is also applicable to an image forming apparatus forming a black and white image.

Further, the aforementioned embodiments are described as using a tandem image forming apparatus, but the present invention is also applicable to an image forming apparatus of the so-called intermediate transfer system, including a belt and secondary transfer unit.

The aforementioned embodiments are described in a case applicable to an image forming apparatus executing printing of an image, but the present invention can be applicable to any machine that executes an image formation accompanied by a development process using toner, for example, the present invention can easily be applied to an electrophotographic printer, a fax machine, a copying machine, and any apparatus containing these functions.

The present invention can of course be arbitrarily altered without deviating from the range of the intent of the invention.

The foregoing description of preferred embodiments of the invention has been presented for purposes of illustration and description, and is not intended to be exhaustive or to limit the invention to the precise form disclosed. The description was selected to best explain the principles of the invention and their practical application to enable others skilled in the art to best utilize the invention in various embodiments and various modifications as are suited to the particular use contemplated. It is intended that the scope of the invention should not be limited by the specification, but be defined by the claims set forth below.

What is claimed is:

1. A development apparatus for developing an electrostatic latent image formed on an electrostatic latent image carrier, comprising:

a developer carrier for carrying and affixing developer charged to a predetermined electric potential to said electrostatic latent image carrier by rotating in a direction facing a circumferential surface of said electrostatic latent image carrier and for applying a development bias voltage $V_D$ that is a prescribed DC voltage, a first power source apparatus applying, to the developer carrier, the voltage $V_D$;

a developer supply unit with a circumferential surface formed of a prescribed elastic material with a hardness of $H_{AF}$ set to $20 \leqq H_{AF} \leqq 80$ measured by an Asker F-type and disposed rotatably contacting said developer carrier to supply developer to said developer carrier so that an amount of push δ, defined as the amount pushed by the contact between said developer supply unit and said developer carrier, is 0.5 mm or below; a second power source apparatus applying, to said developer supply unit, a developer supply bias voltage $V_S$ periodically alternating between voltages $V_{SH}$ and $V_{SL}$, each having the same polarity as a charge polarity of the developer, said second power source apparatus outputting periodically at a frequency f of 500 HZ≦f≦5000 HZ a second peak value at said voltage $V_{SH}$ and having a same polarity as a polarity of the charge of said developer, after outputting a first peak value at said voltage $V_{SL}$ and having the same polarity as the polarity of the charge of said developer; and a developer layer formation unit for thinning developer supplied to the circumferential surface of said developer carrier by said developer supply unit, wherein said developer supply bias voltage $V_S$ superimposing AC voltage on the prescribed DC voltage is applied to said developer supply unit, and has said frequency f of 500 HZ≦f≦5000 HZ and the condition $1 \leqq |V_{SH}-V_D|/|V_D-V_{SL}| \leqq 5$ is fulfilled with $V_{SH}$ as a large peak value with a polarity opposite to the charge polarity of the developer and $V_{SL}$ as the large peak value with the same polarity as the charge polarity of the developer.

2. The development apparatus according to claim 1, wherein the developer supply bias voltage $V_S$ has a wave form of the AC voltage having a rectangular wave form or a triangular wave form superimposed on the prescribed DC voltage.

3. An image forming apparatus forming an image on a prescribed printing medium, containing said development apparatus according to claim 1 as an image forming unit for executing image formation on said fed printing medium.

4. The development apparatus according to claim 1, wherein said first voltage $V_{SL}$ is changed periodically on frequency f to the voltage $V_{SH}$ to an opposite polarity of the charge polarity of the developer, after the voltage is changed to the first peak value at the first voltage $V_{SL}$ at the same polarity as that of the developer.

5. The development apparatus according to claim 4, wherein the developer is charged at a negative polarity, the first power source outputs the voltage $V_D$ at a negative polarity, and the second power source outputs the first peak value at the voltage $V_{SL}$ and the second peak value at the voltage $V_{SH}$ at a negative polarity.

6. The development apparatus according to claim 5, wherein said first power source apparatus supplies voltage at −200V as the DC voltage VD, and said second power source apparatus supplies voltage with the frequency f at 1000 HZ, the first peak value at −300 V and the second peak value at −100V.

7. A development apparatus for developing an electrostatic latent image formed on an electrostatic latent image carrier, comprising:

a developer carrier for carrying and affixing developer charged to a predetermined electric potential to said electrostatic latent image carrier by rotating in a direction facing a circumferential surface of said electrostatic latent image carrier and for applying a development bias voltage $V_D$ that is a prescribed DC voltage, the developer carrier being connected to a first power source apparatus applying the voltage $V_D$;

a developer supply unit with a circumferential surface formed of a prescribed elastic material with a hardness of $H_{AF}$ set to $20 \leqq H_{AF} \leqq 80$ measured by an Asker F-type and disposed rotatably contacting said developer carrier to supply developer to said developer carrier so that an amount of push δ, defined as the amount pushed by the contact between said developer supply unit and said developer carrier, is 0.5 mm or below;

a second power source apparatus applying, to said developer supply unit, a developer supply bias voltage $V_S$ periodically alternating between voltages $V_{SH}$ and $V_{SL}$, each having the same polarity as a charge polarity of the developer, said second power source apparatus outputting periodically at a frequency f of 500 HZ≦f≦5000 HZ a second peak value at said voltage $V_{SH}$ and having a same polarity as a polarity of the charge of said developer, after outputting a first peak value at said voltage $V_{SL}$ and having the same polarity as the polarity of the charge of said developer; and a developer layer formation unit for thinning developer supplied to the circumferential surface of said developer carrier by said developer supply unit, wherein a developer supply bias voltage $V_S$ superimposing AC voltage on the prescribed DC voltage is applied to said developer supply unit; and has a frequency f of 500 HZ≦f≦5000 HZ, with $V_{SH}$ as the large peak value with a polarity opposite to the charge polarity of the developer, $V_{SL}$ as the large peak value with the same polarity as the charge polarity of the developer, and a relation between the development bias voltage $V_D$ and the developer supply bias voltage $V_S$ fulfills the condition $1 \leqq T_R/T_S \leqq 5$ is with $T_S$ set as a time where $V_{SL}<V_S<V_D$ and $T_R$ set as a time where $V_D<V_S<V_{SH}$.

8. The development apparatus according to claim 7, wherein the developer supply bias voltage $V_S$ has a wave form of the AC voltage having a rectangular wave form or a triangular wave form superimposed on the prescribed DC voltage.

9. An image forming apparatus forming an image on a prescribed printing medium, containing said development apparatus according to claim 7 as an image forming unit for executing image formation on said fed printing medium.

* * * * *